United States Patent [19]

Denham et al.

[11] Patent Number: 4,958,510

[45] Date of Patent: Sep. 25, 1990

[54] FASTENER INSTALLATION APPARATUS

[75] Inventors: Keith Denham, Welwyn Garden City; Donald S. Savage, St. Albans; John A. Shortland, Welwyn Garden City, all of England

[73] Assignee: Avdel Systems Limited, Welwyn Garden City, England

[21] Appl. No.: 385,064

[22] Filed: Jul. 26, 1989

[30] Foreign Application Priority Data

Jul. 29, 1988 [GB] United Kingdom ..... 8818078

[51] Int. Cl.[5] ..... B21J 15/20

[52] U.S. Cl. ..... 72/391.4; 72/453.17; 29/243.53

[58] Field of Search ..... 72/391, 453.17, 453.19, 72/114; 29/243.53

[56] References Cited

U.S. PATENT DOCUMENTS

| | | | |
|---|---|---|---|
| 3,122,948 | 3/1964 | Baugh et al. | 72/391 |
| 3,543,560 | 12/1970 | Harris | 72/391 |
| 3,695,086 | 10/1972 | Savage | 72/391 |
| 4,425,780 | 1/1984 | Champoux | 72/391 |
| 4,524,600 | 6/1985 | Champoux et al. | 72/391 |
| 4,557,033 | 12/1985 | Champoux | 72/391 |
| 4,648,259 | 3/1987 | Pendleton | 72/391 |

*Primary Examiner*—David Jones

*Attorney, Agent, or Firm*—Oblon, Spivak, McClelland, Maier & Neustadt

[57] ABSTRACT

Fastener installation apparatus, for installing fasteners such as blind rivets of the type which includes a washer-like member (13) which is free to fall away from the installed fastener, is provided with temporary retaining means for temporarily retaining the washer-like member on the installation apparatus after installation of the fastener. The temporary retaining means comprises a pair of gripping faces (42, 42) which project forwardly from the reaction faces (25, 25) of a pair of members (40 or 48) which are part of the nosepiece of the apparatus. The gripping faces (42, 42) close together automatically to grip the washer-like member as the installation apparatus installs a fastener, and draw apart again to release the washer-like member as the installation apparatus returns to be ready to receive a further fastener for installation.

14 Claims, 4 Drawing Sheets

FASTENER INSTALLATION APPARATUS

BACKGROUND OF THE INVENTION

The invention relates to fastener installation apparatus, and more particularlY to apparatus for installing fasteners of the type comprising a first member, a second member, and a third member, the fastener being installed bY the application of force to the second member relative to the first member, the reaction to the force on the second member being applied to the first member through the third member, the third member being free from the first and the second members on completion of the installation of the fastener The fastener installation apparatus will comprise a first part for engaging the third member to transmit reaction force therebY to the first member, and a second part for engaging the second member to apply force thereto relative to the first member.

More specificallY, the fastener may be of the tYpe in which the first member comprises a tubular shell, the second member comprises a stem inserted into the tubular shell, force being applied to the stem with respect to the shell in order to install the fastener, the reaction to the force on the stem being applied to the shell through the third member which comprises an annular member in contact with the shell and through which the stem also passes.

The installation apparatus for installing such a fastener will normally comprise a first part in the form of an annular face for contacting the annular third member and surrounding an aperture into which the fastener stem is inserted, and a second part comprising stem-engaging means for engaging the stem when the latter is inserted into the aperture.

The third member of the fastener, which is part of the fastener assembly before installation but is free of the installed fastener on completion of installation, acts as a temporary engagement interface between the first part of the installation apparatus and the first member of the fastener. This removes the need for the first part of the apparatus to engage directly with the first member of the fastener.

One example of such a fastener is that marketed under the trademark CHERRY-MAX, and described in British Patent specification No. 1 490 508. In this fastener pulling force is applied to the stem with respect to the shell to cause the stem to move longitudinally with respect to the shell to install the fastener. The annular third member takes the form of a washer assembled on the stem and in contact with the end of the shell. The thrust, which is the reaction to the pull on the stem, is applied by the annular face of the installation apparatus to the end of the shell through the washer, which is also in contact with the annular face of the installation apparatus. On the completion of installation, the stem breaks off level with the end of the shell and the washer is free of the installed fastener.

Another example of such a fastener is a development of the previous example, in which the washer is provided with an annular rim projecting towards the associated shell. On installation of the fastener, the reaction force between the annular rim and the shell deforms the shell so as to form a lock between the shell and the stem. This type of washer is referred to as a lock creator, and fasteners embodying it are known under the trademark LOCK CREATOR MBC or MBC LC.

A further example of such a fastener is that marketed under the trademark COMPOSILOK-II, and described in European Pat. Publication No. 0 152 531. In this fastener the stem and shell are in threaded engagement with each other, and force is applied to the stem with respect to the shell to cause the stem to rotate with respect to the shell, to install the fastener. The annular third member takes the form of a drive nut also threaded on the stem and in contact with the end of the shell. The torque reaction to the rotational force applied to the stem is transmitted by the friction between the drive nut and the shell. On the completion of installation, the drive nut is free of the installed fastener, in threaded engagement with a broken-off portion of the stem.

Fasteners incorporating such intermediate third members are advantageous in that the third member can be shaped and/or dimensioned on one side to engage appropriately with the associated first member of the fastener, at the same time as having the other side of shape and/or dimensions appropriate to engage with standardized first part of the installation apparatus. It is easier and cheaper to manufacture a range of fasteners with third members of different designs, than it is to manufacture a range of fastener installation apparatus with different designs of the first part thereof. This enables the same fastener installation apparatus to install fasteners of different sizes or types of first member. In addition, the presence of the third member during the installation process may, in some circumstances, protect the shell of the fastener and/or the surrounding workpiece in which it is installed from accidental damage by the first part of the installation apparatus.

The disposable lock creator, which is provided as part of each fastener assembly, has to function only once and is then thrown away, and is relatively cheap to manufacture. It replaces a previous similar annular rim which was an integral part of the installation tool annular face, which is expected to function many tens of thousands of times, and is therefore more difficult and expensive to manufacture and to replace, but is subject to wear and vulnerable to damage.

However, the use of fasteners incorporating such intermediate third members has a disadvantage. Since at the completion of .the installation of each fastener the third member is free from the installed fastener, the third member, such as the washer, or lock creator, or drive nut (with a piece of broken-off stem still in threaded engagement with it), then falls away from the installed fastener. It thus causes contamination of the surroundings of the installed fastener. It may fall on a factory workbench or a workshop floor, or it may fall down inside the body of an automobile, aeroplane or aerospace vehicle in which the fastener has just been installed. This may be a hazard, and in many applications this may be so dangerous that the use of such fasteners is not possible.

SUMMARY OF THE INVENTION

The present invention is intended to solve this problem.

The invention provides, in one of its aspects, fastener installation apparatus for installing a fastener of the type comprising a first member, a second member, and a third member, the fastener being installed by the application of force to the second member relative to the first member, the reaction to the force on the second member being applied to the first member through the third member, the third member being free from the first and second members on completion of the installation of the fastener;

which fastener installation apparatus comprises:

a first part for engaging the third member to transmit reaction force thereby to the first member, and a second part for engaging the second member thereby to apply force thereto relative to the first member, and a resilient temporary retaining means for temporarily retaining the third member on the installation apparatus on completion of installation of the fastener.

Further features of the invention will be apparent from the accompanying claims and the following description.

BRIEF DESCRIPTION OF THE DRAWINGS

Two embodiments of the invention in the form of installation tools intended to place fasteners incorporating lock-creator washers, will now be described by way of example and with reference to the accompanying drawings, in which.

DETAILED DESCRIPTION OF THE PREFERRED EMBODIMENT

Figure 1:
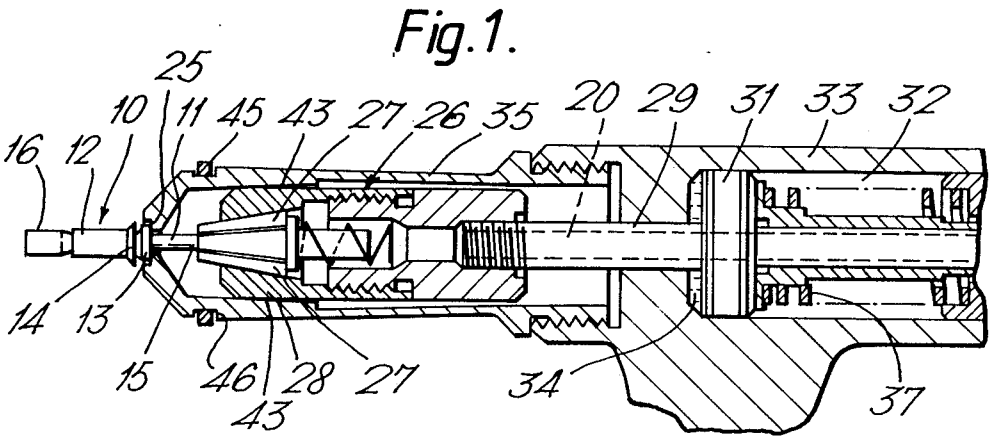
FIGS. 1, 2 and 3 are similar partial axial sections showing part of an installation tool, including the temporary retaining means, in progressive positions during the installation of a fastener.

The fastener of the type which these tools is to install or place is illustrated in FIGS. 1 to 6. The fastener is in the form of a blind rivet 10 (a blind rivet is one which can be placed by access to one side only of the workpiece), and comprises three members. The first member is a tubular shell 12, the second member is a stem 11, and the third member is an annular lock creator washer 13, all three members being made of steel. The shell 12 has a preformed head 14, which in this example is of countersunk form, at one end. The stem 11 comprises an elongated pin 15, formed with an enlarged head 16 at one end. The stem and shell are assembled together with the stem head 16 adjacent the end (the tail end) of the shell remote from the shell head 14, with the pin 15 protruding from the shell head. The lock creator washer 13 comprises a washer body 17 formed integrally with a circular sharp-edged rim 18 (more clearly seen in FIGS. 2 and 7). The washer 13 is assembled on the stem pin with the sharp edge of the rim 18 facing towards, and in contact with, the shell head 14.

In use, the rivet is inserted through an appropriate hole 19 in panels 21, 22 to be riveted together (see FIGS. 2 and 7), until the shell head 14 abuts the nearer panel face. A progressively increasing pulling force is then applied to the stem pin 15, the reaction to the pulling force on the stem being applied to the shell 12 through the washer 13. The stem head 16 enters the shell 12 and enlarges it to form a blind head 23 (FIGS. 2 and 7) which clamps the panels 21, 22 together between the shell head 14 and the blind head 23. When the stem head 16 can enter no further into the shell because of the resistance to expansion provided by the rear panel 22, increasing force on the washer 13 causes the sharp edged rim 18 to deform the material of the shell head so as to engage with the stem pin and lock the stem into the shell. Further increase in tension on the stem pin causes the pin to break, the broken pin tail 24 (FIGS. 2 and 7) and the washer 13 then being free from the placed rivet. The broken off pin tail is ejected down a bore 20 through the tool.

Such rivets, and the manner of placing them as described, above are well known in the art of blind riveting. Also well known is the use of installation apparatus, in the form of a hydraulically-powered placing tool for placing such rivets. Such a tool is illustrated in FIGS. 1 to 5, and comprises a first part in the form of a nosepiece 35 having an annular anvil face 25 for engaging with the lock creator 13 to transmit force thereby to the shell 12 as aforesaid, and a second part in the form of gripping and pulling means 26 for engaging the pin 15 of the stem 11 to apply tension to it relative to the shell as aforesaid. As is well known in the art of blind riveting, the gripping and pulling means comprises a set of gripping jaws 27 retained within an internally tapered jaw housing 28 which is secured to the front end of the draw rod 29. The rear end of the draw rod 29 is secured to a piston 31 sliding in a cylinder 32 formed within a body casting 33. The tool is actuated by supplying hydraulic fluid under pressure to the space 34 in front of the piston 31, so that the draw rod is urged backwards with respect to the body housing.

The annular anvil face 25 is provided at the front end of a tubular nose piece 35 which is secured to the body casting 31 so that the jaw housing 28 is inside the nose piece 35 and the jaws are behind, and aligned with, the annular anvil face 25. In use of the tool to place a blind rivet, the gripping means 26 is initially in its forwards position (FIG. 1) under the urging of a return spring 37. The pin 15 of the stem is inserted through the aperture 36 in the annular anvil 25 and pushes the jaws 27 rearwardly and apart until the pin enters between them and is gripped by them. This is the position shown in FIG. 1. The rivet shell is inserted in the workpiece panels as previously described. The tool is then actuated by supplying hydraulic fluid at a progressively increasing pressure to the space 34 in front of the piston 31 in the cylinder 32, thus actuating the tool to pull the gripping jaws 27 rearwardly to grip and apply increasing tension to the stem pins the reaction force on the shell being applied by the anvil face 25 through the washer 13. The blind rivet is placed as previously described. When the stem has broken, hydraulic pressure to the cylinder is removed, and the gripping means 26 moves forwards again under the urging of return spring 37.

In prior art tools, when the stem pin breaks the washer 13 is free to fall off the anvil face 25 and thereby create a hazard, as previously described.

The tool of the present example is provided with means for temporarily retaining the lock creator washer on the anvil of the nosepiece after the stem has broken, by resiliently gripping the washer. The resilient gripping is arranged to come into effect when the stem gripping means 26 retracts, and to remain gripping the washer until the stem gripping means 26 returns to its forwards position. Thus, after placing a rivet, the tool operator can remove the tool from the workpiece and position it with the anvil in a convenient position (e.g. over a waste receptacle) before releasing the hydraulic pressure in the cylinder space 34 to allow the gripping means 26 to return forwards and release the washer in a safe position.

The resilient gripping means is provided by a relatively simple modification to the nosepiece 35. The modification comprises three features. Firstly, the nosepiece is provided with three longitudinal slots 38 (FIGS. 4 and 5), spaced 120 degrees apart around the nosepiece barrel and extending the anvil aperture 36 rearwardly for the major part of the length of the barrel. The barrel is thus split into three arms 40, which are integral with each other at the rear end of the barrel beyond the ends of the slots 38, and the anvil 25 is also split into three parts, which can move radially inwardly and outwardly with respect to the aperture 36 by flexing of the three arms of the barrel. To reduce fatigue, the rear of each slot 38 ends in a small circular enlargement 39.

Secondly, the anvil is provided with gripping surfaces around its periphery, in the form of a wall 41 which surrounds the anvil and projects forwardly from it. The wall is split into three parts by the slots 38, and thus provides three gripping faces 42 (FIG. 5) which extend transversely to the anvil face 25. It is arranged that, when the arms of the barrel 35 are in the unstressed or undeflected position, the diameter between the gripping faces 42 is slightly less than the outside diameter of the washers 13 of the rivets which the tool is to be used to place.

Figure 2:
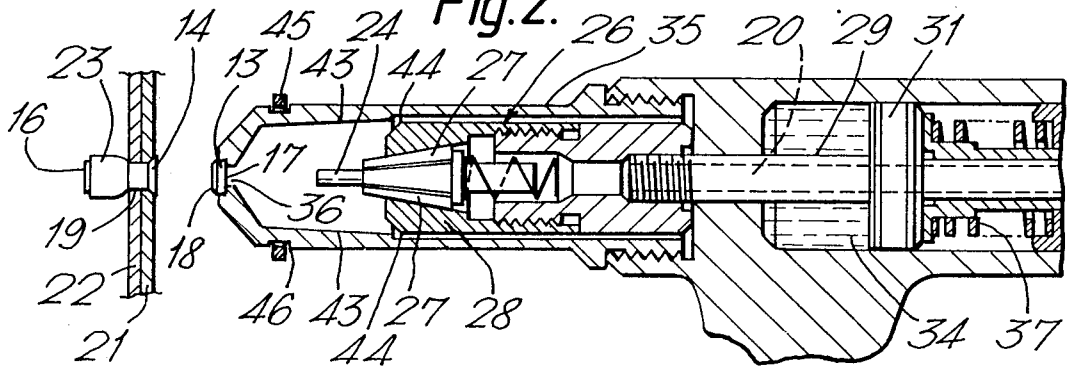
Figure 3:
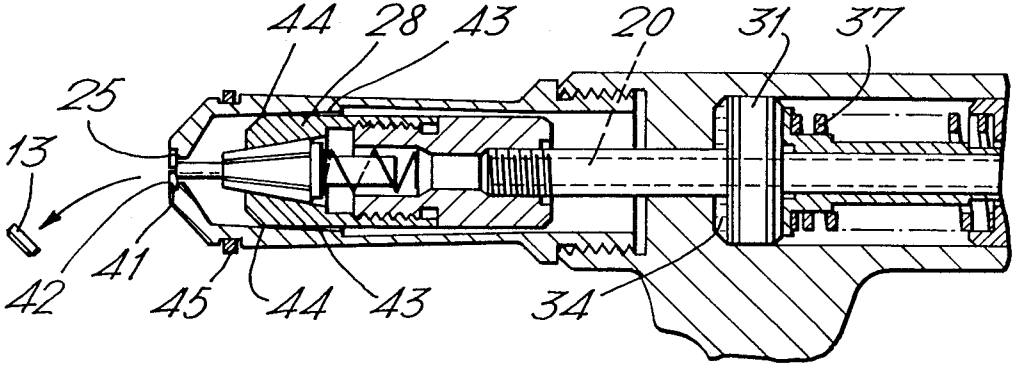
Figure 5:
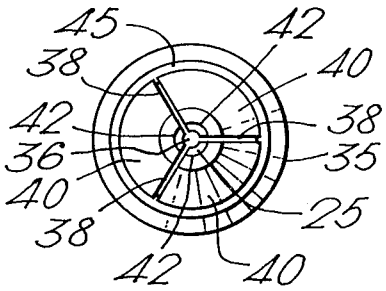
FIG. 5 is an elevation of the nosepiece of the tool.
Figure 4:
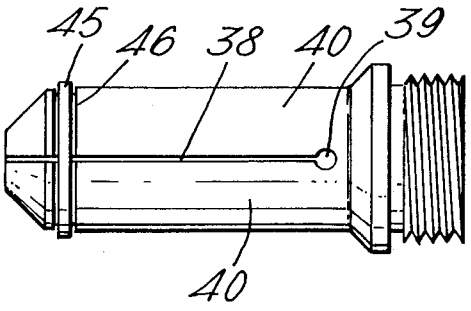
FIG. 4 is an outside elevation of the nosepiece of the tool.

Thirdly, the inside of the forward end of the nosepiece barrel is provided with a slightly converging taper face 43. The arrangement is such that, when the gripping means 26 is withdrawn rearwardly (FIG. 2), the front of the jaw housing 28 is disengaged from the nosepiece taper 43, so that the nosepiece arms close together under their own resilient urging, so as to grip a washer 13, on the anvil 25, between the gripping faces 42, as shown in FIG. 2. When the gripping means is moved forwards, under the urging of the return spring 37, the peripheral edge 44 of the front of the jaw housing 28 enters and engages the nosepiece internal taper 43, and pushes the nosepiece arms apart slightly. This moves the anvil gripping faces 42 apart slightly, so that they no longer grip the washer, as shown in FIG. 3 (and in FIG. 1), and are thus in their releasing position.

Limitation of outward movement of the nosepiece arms is provided by a steel ring 45 received in an annular groove 46 around the barrel near its front end.

The operation of the temporary gripping means will thus be clear. When the placing tool is in the unactuated position (FIG. 1), the jaw housing 28 is in its forwards position and the anvil gripping faces 42 are held apart in their releasing position. When the rivet stem pin 15 is inserted through the anvil aperture 36 and into the jaws 27, the rivet washer 13 can enter between the gripping faces 42 and into contact with the anvil face 25.

When the tool is actuated to place the rivet, the jaw housing 28 retracts and allows the nosepiece barrel arms to close together under their own resilient urging, into their retaining position to grip and retain the washer 13. After the pin 24 of the stem has broken on completion of placing of the fastener, the washer continues to be gripped until the tool is de-actuated, so that the tool can be moved and positioned to release the washer in a convenient and non-hazardous place. Since the gripping of the washer simply results from the resilience of the arms 40, the washer is not substantially deformed thereby.

A similar tool provided with a second form of temporary retaining means is illustrated in FIGS. 6 to 10, like parts in FIGS. 6 to 10 being indicated by the same numerals as in FIGS. 1 to 5.

In this form, the nosepiece barrel 50 is rigid and non-slotted, and the anvil face 25 is provided by a separate anvil nosetip assembly 47. This is generally tubular and is split along an axial plane, and comprises two identical mirror-image halves 48. Each half nosetip can rock about a position substantially mid-way along its junction with the other half. To this end, each half has a forwards contact face 49 and a rearwards contact face 51 which are at a slight angle to each other, meeting at an apex 52.

The two halves together form the nosetip 47, which has a rearwards flange 53, and a forwards flange 60 which forms the anvil face 25 and, around its periphery, extends forwards to provide the gripping faces 42. The rear and front flanges are joined by a body part 54 which extends through an aperture 55 at the front of the nosetip. The washer gripping faces 42 of the nosetip halves are resiliently urged towards each other, into their retaining position, by a garter spring 56 (which may be in the form of a rubber 0-ring}, received in a peripheral groove around the outside of the front ends of the nosetip halves.

Figure 10:
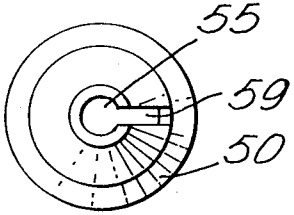
Figure 9:
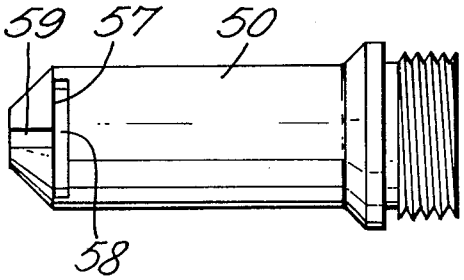

In order to facilitate assembly of the nosetip 47 in the barrel 35, the latter is provided with a side slot 59 extending radially from the aperture 55 (FIG. 10). This slot 59 is wide enough to pass the body portions of only one of the nosetip halves at a time, and ends in a cross-slot 57 through which the rear flange portions 53 of the nosetip can pass.

Figure 6:
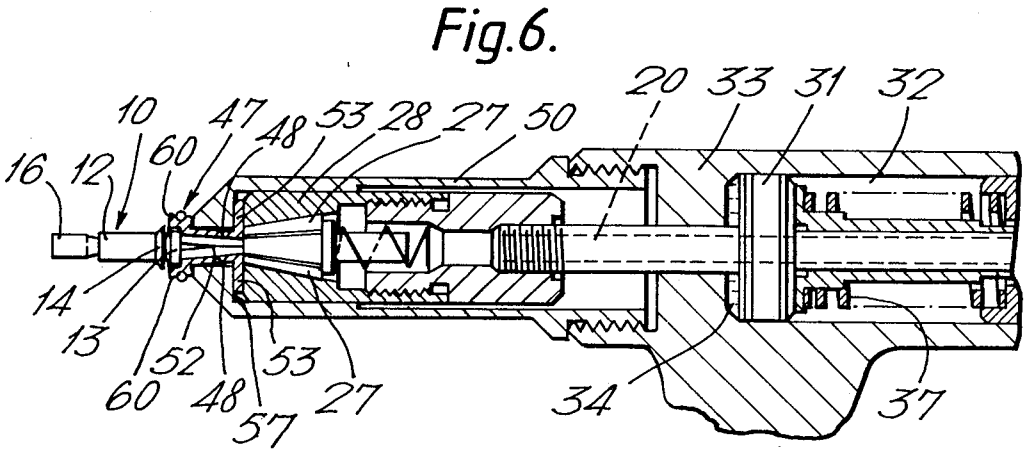
FIGS. 6 and 10 correspond to FIGS. 1 to 5 respectively and show a similar installation tool but with a different form of temporary retaining means.
Figure 7:
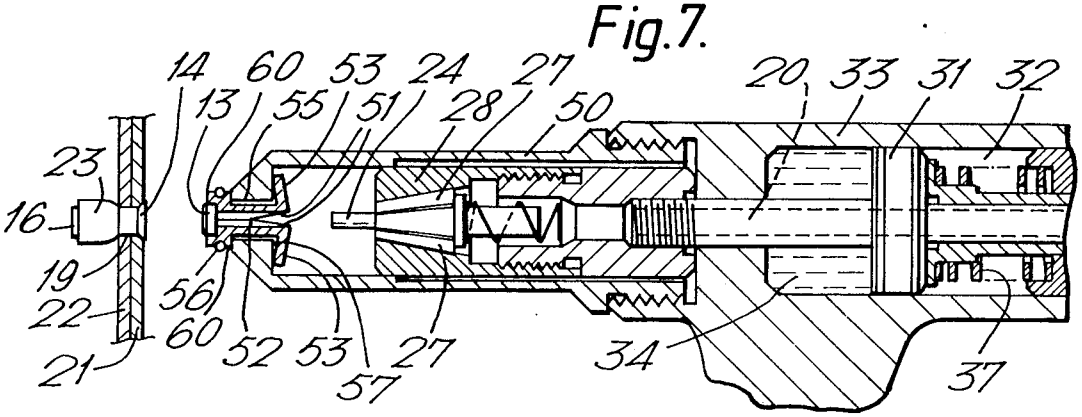
Figure 8:
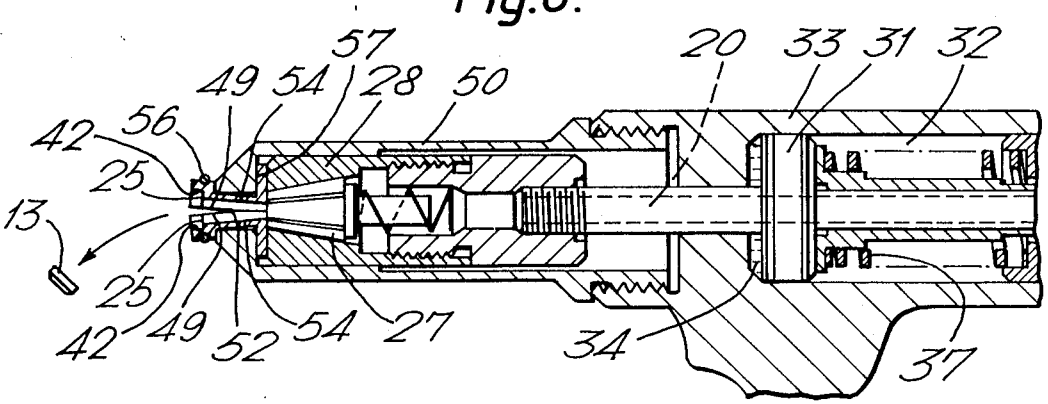

The action of this form of temporary retaining means will be understood by reference to FIGS. 6, 7 and 8.

When the jaw housing 28 is in its forwards position (FIGS. 6 and 8), its front end contacts the rear flange 53 of the nosetip and pushes the nosetip forwards, pushing the rear flange halves 53 flat against a flat transverse face 57 on the back of the front end of the nosepiece barrel 35. This causes the fronts of the nosetip halves to be pushed apart, against the urging of the spring 56, so that the gripping faces 42 are in their releasing position. The rear faces 51 of the nosetip halves are in contact (or nearly so), with the forward faces 49 diverging from each other. When the tool is actuated and the jaw housing 28 retracts, the nosetip halves can rock about their apexes 52, under the urging of the spring 56. The washer-gripping faces 42 at the front of the nosetip move towards each other into their gripping position, so that the forwards nosetip faces 49 come into contact with each other (or nearly so), whilst the rearwards faces move apart from each other and the engagement of the outer ends of the flange halves 53 on the nosepiece back face 57 pulls the nosetip slightly rearwardly.

The action of the temporary retaining means in use of the placing tool has the same function as that described with respect to FIGS. 1 to 5.

It should be noted that, in both FIG. 1 to 3 and 6 to 8, the amount of movement of the washer gripping walls 42 and of the associated parts of the anvil are exaggerated for clarity of illustration. In practice the movement of the gripping walls may be only a few thousands of an inch or a few tenths of a millimetre.

The invention is not restricted to the details of the foregoing examples.

We claim:

1. Fastener installation apparatus for installing a fastener of the type comprising a first member, a second member, and a third member, the fastener being installed by the application of force to the second member relative to the first member, the reaction to the force on the second member being applied to the first member through the third member, the third member being free from the first and second members on completion of the installation of the fastener;

which fastener installation apparatus comprises:

a first part for engaging the third member to transmit reaction force thereby to the first member, a second part for engaging the second member thereby to apply force thereto relative to the first member, and resilient temporary retaining means having resilience in a direction toward the free third member for resiliently gripping the free third member and actuated in response to a fastener installation operation by the fastener installation apparatus for temporarily retaining the free third member on the installation apparatus on completion of installation of the fastener due to the resilience of said temporary retaining means, whereby the free third member is not substantially deformed.

2. Apparatus as claimed in claim 1, in which the temporary retaining means retains the third member by applying a resilient gripping force to it.

3. Apparatus as claimed in claim 2, in which the temporary retaining means applies the gripping force to the third member in a direction transverse to that in which reaction force is applied to it.

4. Apparatus as claimed in claim 1, in which the temporary retaining means is provided by the first part of the apparatus.

5. Apparatus as claimed in claim 4, in which the first part of the installation apparatus comprises a plurality of members which are adjustable relatively to each other between a retaining position in which they resiliently retain the third member and a releasing position in which they release the third member.

6. Apparatus as claimed in any of claims 1 to 4, in which the temporary retaining means is arranged to retain the third member when the second part of the apparatus is operated to apply force to the second member of the fastener.

7. Apparatus as claimed in any one of claims 1 to 4, including means for biasing the temporary retaining means towards the condition in which it retains the third member.

8. Apparatus as claimed in claim 1, in which the second part is movable to apply said force to the second member of the fastener, and the temporary retaining means is actuated in response to said application of force to the second member of the fastener.

9. Apparatus as claimed in claim 8, in which the temporary retaining means comprises means for releasing the third member of the fastener upon a return of the second part of the apparatus to an initial position thereof.

10. Apparatus as claimed in claim 5, in which the first part of the installation apparatus comprises a plurality of members, each of which comprises a reaction face for applying the reaction force to the third member of the fastener, and a gripping face extending transverse to the reaction face for applying a gripping force to the third member in a direction transverse to that in which reaction force is applied.

11. Apparatus as claimed in claim 10, in which the plurality of members are integral with each other at a position remote from their reaction and gripping faces.

12. Apparatus as claimed in claim 11, in which the members move between their retaining and releasing positions by flexing.

13. Apparatus as claimed in claim 10, in which the plurality of members are separate from each other.

14. Apparatus as claimed in claim 13, in which the members move between their retaining and releasing positions by a rocking movement.

* * * * *